US009919898B2

(12) United States Patent
Osmanbasic et al.

(10) Patent No.: US 9,919,898 B2
(45) Date of Patent: Mar. 20, 2018

(54) SAFETY BRAKE DEVICE FOR AN ELEVATOR INSTALLATION

(71) Applicant: Inventio AG, Hergiswil NW (CH)

(72) Inventors: Faruk Osmanbasic, Cham (CH); Miriam Heini, Eschenbach (CH); Quirin Kollros, Rothenburg (CH); Simon Barmettler, Root (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 15/095,207

(22) Filed: Apr. 11, 2016

(65) Prior Publication Data

US 2016/0318736 A1 Nov. 3, 2016

Related U.S. Application Data

(63) Continuation of application No. 13/847,818, filed on Mar. 20, 2013, now Pat. No. 9,457,990.

(30) Foreign Application Priority Data

Mar. 20, 2012 (EP) ..... 12160396

(51) Int. Cl.

| | |
|---|---|
| ***B66B 5/20*** | (2006.01) |
| *B66B 5/02* | (2006.01) |
| *B66B 9/00* | (2006.01) |

(52) U.S. Cl.

CPC ..... *B66B 5/20* (2013.01); *B66B 5/02* (2013.01); *B66B 9/00* (2013.01)

(58) Field of Classification Search

CPC ..... B66B 5/02; B66B 5/20; B66B 9/00

See application file for complete search history.

(56) References Cited

U.S. PATENT DOCUMENTS

| | | | |
|---|---|---|---|
| 729,989 | A | 6/1903 | Zaruba et al. |
| 5,228,540 | A | 7/1993 | Glaser |
| 6,173,813 | B1 | 1/2001 | Rebillard |

(Continued)

FOREIGN PATENT DOCUMENTS

| | | | |
|---|---|---|---|
| DE | 19606861 | A1 | 8/1997 |
| EP | 0899231 | B1 | 3/1999 |

(Continued)

*Primary Examiner* — William E Dondero
*Assistant Examiner* — Diem M Tran
(74) *Attorney, Agent, or Firm* — William J. Clemens; Shumaker, Loop & Kendrick LLP

(57) ABSTRACT

A safety brake device at a load receiving component of an elevator installation includes brake equipment that co-operates with a guide rail of the load receiving component. The brake equipment includes a cam disc that is rotatable about a cam disc axis and for activation of the safety brake device is set into a rotation through an activation rotational angle by an activating mechanism, wherein as a consequence of such rotation the cam disc comes into contact with the guide rail, whereby the guide rail moving relative to the safety brake device when the load receiving component is travelling rotates the cam disc into a position in which the brake equipment and thus the safety brake device produce an intended braking action relative to the guide rail. The activating mechanism includes a pivotally mounted activating lever driven by an activating spring to rotate the cam disc.

23 Claims, 9 Drawing Sheets

(56) References Cited

U.S. PATENT DOCUMENTS

| | | | | |
|---|---|---|---|---|
| 6,176,350 | B1 | 1/2001 | Schlosser | |
| 6,318,505 | B1 | 11/2001 | De Angelis | |
| 6,902,369 | B2 | 6/2005 | Tanigawa | |
| 7,299,898 | B2 * | 11/2007 | Husmann | B66B 5/20 187/365 |
| 2006/0090969 | A1 | 5/2006 | Eckenstein | |
| 2007/0007083 | A1 | 1/2007 | Husmann | |
| 2010/0038184 | A1 | 2/2010 | Emmerich | |
| 2012/0152658 | A1 | 6/2012 | Osmanbasic | |
| 2012/0152663 | A1 | 6/2012 | Legeret | |
| 2013/0081907 | A1 | 4/2013 | Meierhans | |
| 2013/0081908 | A1 | 4/2013 | Meierhans | |
| 2013/0248298 | A1 | 9/2013 | Osmanbasic et al. | |

FOREIGN PATENT DOCUMENTS

| | | | |
|---|---|---|---|
| EP | 1902993 | A1 | 3/2008 |
| EP | 2112116 | A1 | 10/2009 |
| JP | 2000310261 | A | 11/2000 |
| SU | 1752703 | A1 | 8/1992 |
| WO | 2012080104 | A1 | 6/2012 |

* cited by examiner

2 CAGE
4 COUNTERWEIGHT
6 DRIVE UNIT
8, 9, 10, 11 STORIES
12 ENGINE ROOM
25 WEIGHT
29 SWITCH
31 CONTROL
38 SAFETY BRAKE DEVICE

SAFETY BRAKE DEVICE FOR AN ELEVATOR INSTALLATION

CROSS-REFERENCE TO RELATED APPLICATION

This application is a continuation of the co-pending U.S. patent application Ser. No. 13/847,818 filed Mar. 20, 2013. This application claims priority to European Patent Application No. 12160396.3, filed Mar. 20, 2012, which is incorporated herein by reference.

FIELD

The present disclosure relates to safety brakes for elevator installations.

BACKGROUND

In some elevator installations, at least one safety system is provided to combat uncontrolled vertical movements of a load receiving means or a counterweight of the elevator installation.

The safety system comprises at least one safety brake device with brake equipment which can be brought into an activated, braking state and a deactivated, non-braking state, wherein the safety brake device in the activated state connects the load receiving means with a guide rail by friction couple. The non-braking state of the brake equipment is also termed normal operating state. In addition, the safety system comprises at least one activating mechanism activating the brake equipment.

Such safety systems, which function exclusively mechanically, are widespread. In that case use is made of a limiter cable which is guided in the upper region of the elevator shaft around the cable pulley of a speed limiter and in the lower region around a deflecting cable pulley, wherein one of the runs of the limiter cable extending between these cable pulleys is coupled with an activating mechanism of the safety brake device at the load receiving means. The movements of the load receiving means or the counterweight are thereby transmitted by way of the limiter cable to the cable pulley at the speed limiter so that in the case of movement of the load receiving means or the counterweight this cable pulley executes a rotational movement, the rotational speed of which is proportional to the travel speed of the load receiving means. The speed limiter functions so that when an impermissibly high speed of the receiving means or the counterweight occurs the cable pulley of the speed limiter is blocked or a cable brake of the speed limited is activated. The limiter cable and thus the run of the limiter cable moving synchronously with the load receiving means or the counterweight are thereby stopped. This has the consequence that the stationary limiter cable activates the activating mechanism of the safety brake, which is mounted on the still-moving load receiving means or counterweight, and the load receiving means is brought to a standstill.

For the sake of simplicity not only load receiving means such as, for example, elevator cages, but also counterweights are to be understood in the following by the term "load receiving means".

A potential disadvantage of such safety systems with speed limiters and limiter cables is, apart from the high constructional cost, that they do not do adequate justice to the demands of elevator installations without an engine room. Thus, the omission of the engine room can mean that an unrestricted capability of access to the speed limiter is not guaranteed.

Safety systems in which activation of the safety brake device takes place electromechanically are on the market to an increasing extent. Detection of excess speed is carried out electronically. Such safety systems dispense with a purely mechanical speed limiter, thus a limiter functioning even in the case of power failure. An emergency power battery or accumulator is usually provided in such safety systems for the case of a power failure.

SUMMARY

In some embodiments, a safety brake device is mounted on load receiving means and comprises brake equipment co-operating with a guide rail of the load receiving means, which brake equipment contains a cam disc rotatable about a cam disc axis, wherein the safety brake device comprises an electrically controlled activating mechanism which for activation of the safety brake device rotates the cam disc through an activation rotational angle, and wherein the cam disc is so designed that as a consequence of the rotation through the activation rotational angle it comes into contact with the guide rail, whereby the guide rail moving relative to the safety brake device when the load receiving means is travelling rotates the cam disc into a position in which the brake equipment and thus the safety brake device produce an intended braking action relative to the guide rail.

In some embodiments, for activation of the safety brake device by an actuator only the cam disc has to be rotated through a triggering rotational angle and the housing together with the entire, heavy safety brake device does not have to be displaced laterally.

According to some embodiments, the electrically controlled activating mechanism comprises a pivotably mounted activating lever, an electromagnet and an activating spring, wherein the activating lever is fixable by the switched-on electromagnet in an initial position corresponding with a normal operating state of the brake equipment and, through switching-off of the electromagnet, is movable—driven by the activating spring—in the direction of an end position, wherein the activating lever is so coupled with the cam disc that the movement of the activating lever from its initial position in the direction of the end position produces the rotation of the cam disc through the activation rotational angle and thereby brings the cam disc into contact with the guide rail.

The ratio between the holding force, which the electromagnet in the initial position can exert on the activating lever when voltage is applied, to the force, which is effective at the electromagnet, of the biased activating spring lies in a range of 1.5:1 to 3:1, but is preferably approximately 2:1. The electromagnet is thus possibly designed so that it exerts on the activating lever merely a secure retaining function. As soon as, however, an electronic speed limiter, for example in the case of excess speed, produces an interruption of the power feed to the electromagnet the activating lever changes from its initial position in the direction of the end position.

Through its movement from the initial position in the direction of the end position the activating lever driven by the force of the activating spring produces a rotation of the cam disc, for example in that a first contact surface in an end region of the activating lever engages an entrainer of the cam disc. In the case of a detected uncontrolled movement of the load receiving means the electromagnet is switched off, whereby the activating lever executes an activating movement from its initial position in the direction of the end position. In that case its first contact surface drives the entrainer of the cam disc so that the cam disc is set into rotation and departs from its preferably spring-positioned normal position, whereby the periphery of the cam disc comes into contact with the guide rail. This has the consequence that the cam disc is further rotated by the guide rail, which is moving relative to the safety brake device, which—as described later—leads to the build-up of braking forces and thereby to braking of the load receiving means.

The end region of the activating lever can have a second contact surface which is effective in the following case. When the cam disc comes into contact with the guide rail, for example as a consequence of imprecise or excessively resilient guidance of the load receiving means, the cam disc can be rotated by the guide rail so that the safety brake device is unintentionally activated. In such a case only one of usually two safety brake devices is activated, whilst the second safety brake device remains inactive. In order to avoid this situation, a second contact surface can be so arranged in the end region of the activating lever that the entrainer of the unintentionally rotated cam disc causes the associated activating lever to leave its initial position and move in the direction of the end position. This can be detected by, for example, a detector or a switch so that the second safety brake device can be similarly activated approximately synchronously either mechanically or electrically.

The afore-described activating mechanism comprising an electromagnet and an activating lever with activating spring acts on brake equipment which comprises a brake caliper engaging around the guide web of the guide rail. Mounted within this brake caliper on one side of the guide web is a first brake element which is held in vertical direction in the brake saddle and supported in horizontal direction resiliently relative to the brake caliper by means of a plate-spring packet. A second brake element is arranged on the other side of the guide web. This is supported and guided in horizontal direction and vertical direction by at least one projection, which is present in the form of an eccentric disc, at a cam disc rotatably mounted on the brake caliper. The cam disc of the brake equipment, the first and second brake elements and the plate-spring packet are connected with the brake caliper. As still to be described in the following, in that case the brake equipment or the brake caliper is possibly mounted to be displaceable at right angles to the guide surfaces of the guide rail or of the guide web relative to a support frame of the load receiving means on which the entire brake equipment is mounted. The support frame can also be an integrated component of the load receiving means.

The cam disc is possibly a disc which is mounted on a rotational axle fixed to the brake caliper and the periphery of which has a flat spring-positioned to be directed towards the guide rail in normal operation, wherein a peripheral section having an increasing radius with increasing rotational angle adjoins the flat.

In the first normal operating state, which is present in normal operation of the elevator installation, of the safety brake device the flat produces a sufficient spacing between the cam disc and the guide rail. On activation of the safety brake device the cam disc is rotated by the activating lever through the activation rotational angle, whereby the peripheral section, which adjoins the flat and increases in radius, of the cam disc comes into contact with the guide rail. This has the consequence that the cam disc is further rotated by the guide rail, which is moving relative to the safety brake device, into a position in which the brake equipment and thus the safety brake device produce an intended braking action relative to the guide rail. This happens as follows: The rolling of the peripheral section, which increases in radius, of the cam disc on the guide rail has the effect that the cam disc—and with it the entire brake caliper—is with increasing rotational angle of the cam disc displaced through an increasing distance laterally relative to the guide rail and to the support frame guided at the guide rail. This has the consequence of the second brake element bearing against the guide surface associated therewith of the guide rail as well as an increasing compression of the plate-spring packet acting on this brake element. An increasing rise in the pressing force between the second brake element and the guide rail as well as the pressing force between the cam disc and the guide rail thereby results. However, in the course of rotation of the cam disc the second brake element supported on at least one eccentric disc connected with the cam disc is pressed against the guide rail, wherein the reaction force with respect to this rising pressing force of the second brake element counteracts the pressing force of the cam disc. As soon as the residual pressing force of the cam disc is, due to this process, no longer sufficient to further rotate the cam disc by friction at the guide rail the cam disc begins to slide on the guide rail, in which case the previously attained pressing forces and thus the desired braking force of the safety brake device are maintained until standstill of the load receiving means.

In principle it would also be possible not to convert the rotational movement of the cam disc into a displacement of the brake element, but to integrate a brake element in the cam disc. This can be achieved, for example, with a cam disc in which the periphery is formed so that a flat is adjoined by a peripheral section which increases in radius and which is followed by a rising, straight peripheral section. A rotation of the cam disc through the activation angle has the consequence that the periphery of the cam disc comes into contact with the guide rail so that the cam disc is further rotated by the guide rail moving relative to the safety brake device. Rolling of the peripheral section, which increases in radius, on the guide rail in that case causes displacement of the entire brake caliper. Resulting from that is an increasing compression of a spring element arranged between the brake caliper and a first brake element as well as an increasing pressing force between the cam disc and the guide rail. The rising, straight peripheral section adjoining the peripheral section increasing in radius causes arrest of the rotational movement of the cam disc, in which case the pressing forces are maintained. In this position of the cam disc the straight peripheral section of the cam disc slides, as second brake element, on the guide rail until the pressing force or the thereby generated braking force has produced standstill of the load receiving means.

The initiation of the braking or arresting process of the safety brake device takes place in steps. A first step is characterized in that the activating lever is no longer held by the electromagnet, i.e. it is released. In a further step, the activating spring causes a pivot movement of the activating lever, whereby the cam disc rotatably mounted in the brake caliper is rotated through an activation rotational angle so that the flat of the cam disc rotates out of a position aligned parallel to the guide rail and a peripheral section, which adjoins the flat and increases in radius, of the cam disc comes into contact with the guide rail. The activating spring should be designed so that it can rotate the cam disc through a required activation rotational angle by way of the activating lever. In that case on the one hand a travel-through play between the flat of the cam disc and the guide rail of approximately 1 to 3.5 millimeters should be eliminated and on the other hand the rotation of the cam disc should be subsequently guaranteed by friction of its periphery at the guide rail moving relative to the safety brake device or relative to the cam disc.

In a further step the contact between the peripheral section, which increases in radius, of the cam disc and the guide rail moving relative to the safety brake device causes a further rotation of the cam disc until the cam disc has reached a position in which the cam disc through co-operation with other elements of the brake equipment is strongly pressed against the guide rail and has the effect that the brake equipment generates an intended braking action relative to the guide rail. The force of the activating spring of the activating lever is no longer required for this process. In order to help ensure the requisite friction between the periphery of the cam disc and the guide rail at least a part of the peripheral surface of the cam disc is provided with a toothing or micro-toothing.

In one of the possible embodiments of the safety brake device the brake surfaces of the brake elements of the brake equipment are arranged at a small angle relative to the longitudinal direction of the guide rail so that on initiation of the braking process in a downward movement of the load receiving means initially the lower ends of the brake elements bear against the guide rail. Vibrations or chattering or even jumping of the brake elements, particularly in the case of downward movement of the load receiving means, can thereby be avoided.

At least the brake equipment with the brake caliper, the cam disc, the first brake element with the associated spring elements—in another form of embodiment also the entire activating mechanism with the electromagnet, the activating lever and the activating spring—are mounted in a support frame of the load receiving means to be 'floating'. This means that the brake is displaceable in at least the direction, which lies at right angles to the guide surface of the guide rail, within a limited range relative to the support frame.

Another embodiment of a disclosed safety brake device comprises, apart from the activating spring, a second spring. This spring can be, for example, a tension spring which resiliently positions the cam disc in its normal position. This spring is termed resetting spring in the following. The resetting spring is so designed and arranged that the cam disc is held in its normal position in normal operation of the elevator installation. The resetting spring is sufficiently yielding so that the rotation of the cam disc by the activating lever or by the guide rail is not hampered. For example, the resetting spring can be coupled with the activating lever in such a manner that in the case of release and subsequent movement of the activating lever a bias of the resetting spring is reduced.

In order to enable simplified resetting of an activated, i.e. fixedly seated on the guide rail, safety brake device in the case of one of the possible forms of embodiment of the safety brake device the brake equipment is mounted on the support frame of the load receiving means to be displaced vertically, i.e. in the travel direction of the load receiving means. This takes place in that, for example, the brake equipment is guided in vertical slots in the support frame by means of support pins. In addition, the brake equipment is so supported relative to the support frame in vertical direction by means of at least one support spring that the support spring presses the brake equipment in normal operation resiliently against an upper abutment formed by the upper ends of the slots. The entire activating mechanism, comprising the electromagnet and the activating lever with its pivot bearing is directly fastened to the support frame.

In this way a resetting function is realized with a described safety brake device, which function takes place in accordance with the following:

The support frame or the load receiving means is raised, wherein it executes a relative movement with respect to the brake equipment, which is fixedly seated on the guide rail, against the force of the support spring. In that case the support pins begin to move within the slots from the upper ends of the respective slots to the lower ends. The relative movement between the support frame and the brake equipment fixedly seated on the guide rail is utilized in order to let a lever abutment to be so pressed against the activating lever that the activating lever is pivoted back against the action of the activating spring into a resetting position in which the activating lever can be picked up again by the electromagnet switched back on. The activating spring is then fully stressed again. The lever abutment is so designed or fastened that through the described relative movement it rotates the activating lever, to the advantage of reliable resetting, somewhat back beyond its initial position into the resetting position. The electromagnet is possibly mounted to be resiliently pivotable in order to be able to allow the path of the activating lever into the resetting position without damage. The electromagnet itself can thus be designed as an adhesion or retaining magnet, since it merely has to hold the already-contacting activating lever. The electromagnet does not have to perform any resetting work and, in particular, it does not have to overcome an air gap during the resetting.

The support pins of the brake equipment have arrived at the lower ends of the slots in the support frame and thus further raising of the support frame now produces raising of the brake equipment relative to the guide rail. This has the effect that the cam disc, which is pressed against the guide rail, of the brake equipment is rotated back by the guide rail approximately into the normal position of the cam disc, whereby the pressing forces between the cam disc and the guide rail as well as between the brake elements and the guide rail are cancelled. This process is not obstructed by the activating lever.

As soon as—during the resetting—the flat of the cam disc lies approximately parallel to the longitudinal axis of the guide rail the restraining spring draws the cam disc back into the normal position thereof until the flat is aligned completely parallel to the guide rail. The brake element is free. The entrainer of the cam disc is again against the activating lever.

A safety brake device, which substantially has the aforedescribed features and which is mounted on a support frame of the load receiving means and co-operates with a guide rail, enables—on detection of an impermissible movement state of the elevator installation—performance of a method for activating and resetting such a safety brake device by the following method steps:

a) releasing an activating lever, which is mounted in a pivot bearing, by switching off an electromagnet;

b) pivoting the activating lever by an activating spring, whereby a rotatably mounted cam disc of brake equipment is rotated through an activating rotational angle out of the normal position of the cam disc so that the periphery of the cam disc comes into contact with the guide rail moving relative to the safety brake device;

c) further rotating the cam disc by the guide rail, wherein a peripheral section, which increases in radius, of the cam disc rolls on the guide rail, whereby the cam disc and brake elements of the brake equipment are pressed by a provided pressing force against the guide rail and bring the load receiving means to a standstill;

d) resetting the safety brake device by raising the support frame of the load receiving means, in which case the support frame executes a relative movement limited by the upper abutment and a lower abutment with respect to the brake equipment, which is fixed on the guide rail after a safety braking process and which is guided at the support frame to be movable in vertical direction and is resiliently pressed against an upper abutment at the support frame by means of a support spring;

as a consequence of the relative movement between support frame and brake equipment the activating lever is moved by a lever abutment against the action of the activating spring into a resetting position $P_R$ in which the activating lever can be picked up and held by the electromagnet switched back on; and if as a consequence of upward movement of the support frame of the load receiving means the lower abutment at the support frame hits against the brake equipment fixed on the guide rail, the cam disc, which is pressed against the guide rail, of the brake equipment is with utilization of at least the kinetic energy of the support frame rotated back by the guide rail, whereby the brake equipment is brought back into its normal operating state.

Optionally, a further embodiment of a disclosed safety brake device can comprise a switch for detecting the brake or the brake equipment. This switch detects the initial position of the activating lever and is activated in the case of movements of the latter. It thereby gives a signal interrupting the safety circuit of the elevator installation so that in the case of placing the brake or the brake equipment in a functional state the drive of the elevator installation is switched off.

The activating spring of the activating lever can also be designed as a compression spring, tension spring or bending spring instead of a torsion spring.

A further variant of embodiment of the safety brake device provides the possibility of mechanical synchronization between two or more safety brake devices at a load receiving means. For this purpose it is possible to connect the activating levers of two or more safety brake devices together by way of a common shaft and to fixedly arrange the pivot bearings of two or more activating levers on a common, rotatably mounted shaft. 'Activation' of a single activating lever is thus sufficient and synchronously causes the same movement in each other activating lever.

BRIEF DESCRIPTION OF THE DRAWINGS

The disclosure is explained in more detail in the following by way of example on the basis of figures. The figures are described conjunctively and generally. The same reference numerals denote equivalent or the same device parts and reference numerals with different indices indicate functionally equivalent or similar, but separate, device parts even, when they are identical with others, but are arranged at a different location or in another variant of embodiment are a part of another overall function.

In that case.

DETAILED DESCRIPTION

Figure 1:
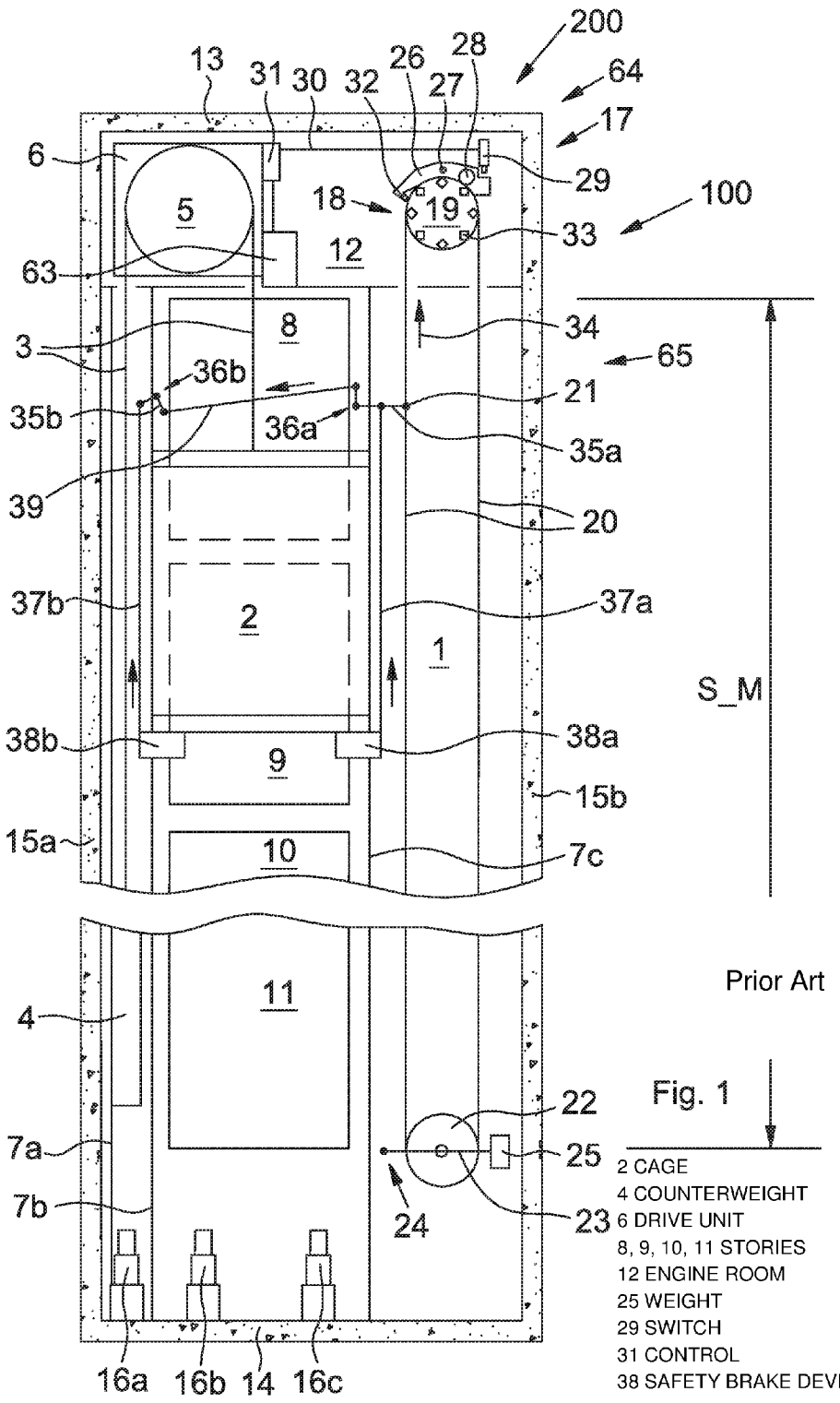
Prior Art Fig. 1
FIG. 1 shows a schematic illustration of an elevator installation with an arrangement of a speed limiter system according to the prior art.

FIG. 1 shows an elevator installation 100 such as is known from the prior art. A load receiving means or an elevator cage 2 is arranged in an elevator shaft 1 to be movable and is connected by way of a support means 3 with a similarly movable counterweight 4. The support means 3 is, in operation, driven by a drive pulley 5 of a drive unit 6 which is arranged in the uppermost region of the elevator shaft 1 in an engine room 12. The elevator cage 2 and the counterweight 4 are guided by means of guide rails 7*a* or 7*b* and 7*c* extending over the shaft height.

The elevator cage 2 can serve an uppermost story 8, further stories 9 and 10 and a lowermost story 11 and thus describe a maximum travel path S_M. The elevator shaft 1 is formed from shaft side walls 15*a* and 15*b*, a shaft ceiling 13 and a shaft floor 14, on which a shaft floor buffer 16*a* for the counterweight 4 and two shaft floor buffers 16*b* and 16*c* for the elevator cage 2 are arranged.

The elevator installation 100 further comprises a speed limiter system 200. This in turn comprises a speed limiter 17 with a cable pulley 18 fixedly connected with a cam disc 19. The cable pulley 18 and the cam disc 19 are driven by way of a limiter cable 20, because the limiter cable 20 conjunctively describes the respective upward or downward movements of the elevator cage 2 by virtue of a fixed connection in the form of a cable coupling 21 connected with the load receiving means. The limiter cable 20 is for that purpose guided as an endless loop over a tensioning roller 22 which can be tensioned by a tensioning lever 23 in that the tensioning lever 23 is rotatably mounted in a rotary bearing 24 and a weight 25 is displaceably arranged on the tensioning lever 23.

The speed limiter 17 further comprises a pendulum 26 which is arranged at an axle 27 to be pivotable in both directions of rotation. Arranged at one side of the pendulum 26 is a roller 28 which is drawn by a resetting spring (not illustrated in more detail in this figure) against the rises of the cam disc 19.

As a first safety step the speed limiter system 200 provides that in the case of attaining a first excess speed VCK the roller 28 can no longer run completely through the valleys between the rises of the cam disc 19 and thus the pendulum 26 begins to rise up in counter-clockwise sense. This rising movement activates a pre-contact switch 29 which electrically switches off and stops the drive unit 6 by way of a control line 30 and by way of a control 31. The control 31 is connected with a control device 63 for the entire elevator installation 100, into which all control signals and sensor data flow in common.

As a second, purely mechanical safety step the speed limiter system 200 provides that on reaching a second, higher excess speed VCA the pendulum 26 rises still further in counter-clockwise sense and thus a pendulum nose 32 engages in recesses or in blocking dogs 33 at the cam disc 19. The cable pulley 18 is thereby blocked and by virtue of the friction between the cable pulley 18 and the limiter cable 20 generates a tension force 34 by means of which an L-shaped double lever 35*a* is rotated at an articulation point. The approximately horizontal limb of the L-shaped double lever 35*a* thus activates, by way of an activating rod 37*a*, a symbolically illustrated safety brake device 38*a*. The other, approximately vertical limb of the double lever 35*a* at the same time exerts a thrust force on a connecting rod 39 and a second L-shaped double lever 35*b* thus rotates about an articulation point 36*b*. As a result, a further activating rod 37*b* in turn activates a second—also only symbolically illustrated—safety brake device 38*b*. In this way a purely mechanical activation of two mechanically operating safety brake devices 38*a* and 38*b* is realized, which in the case of excess speed or an imminent risk situation fixes the elevator cage 2 to the guide rails 7*b* and 7*c*.

Figure 2:
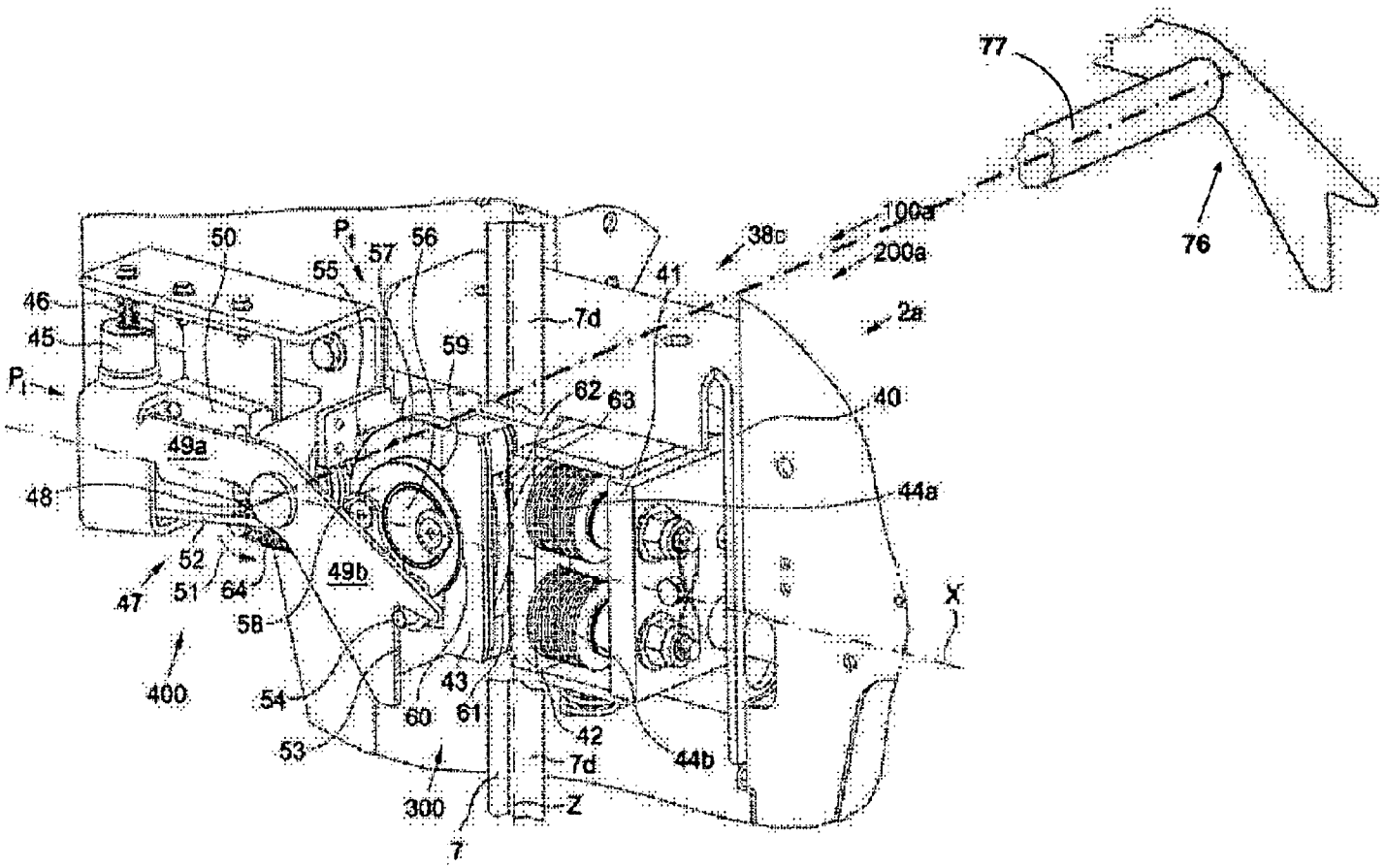
FIG. 2 shows a schematic and perspective illustration of a first safety brake device in a normal operating state.

FIG. 2 shows in a schematic and perspective illustration a form of embodiment of a safety brake device 38*c*, which is a component of an elevator installation 100*a* or of a speed limiting or safety system 200*a* and is arranged in a support frame 40 of a load receiving means 2*a*. The support frame 40 can also be the support frame of a counterweight. The support frame 40 can also be an integrated component of the load receiving means 2*a*.

The safety brake device 38*c* comprises brake equipment 300 and an activating mechanism 400. The brake equipment 300 in turn comprises a brake caliper 41, which is arranged to be displaceable within the support frame 40 not only in vertical direction, but also in horizontal direction, i.e. along both a Z axis and an X axis. In that case the brake caliper when the brake equipment is non-activated is urged in yielding manner, i.e. by means of springs, on the one hand to the right and on the other hand upwardly into a respective abutment position within the support frame 40. A first brake element 42 and a second brake element 43 are arranged in the brake caliper 41 to be displaceable along an adjusting axis X. The adjusting axis X is approximately perpendicular to a longitudinal axis Z of an indicated guide rail 7, the guide web 7*d* of which protrudes into the intermediate space between the first brake element 42 and the second brake element 43. The first brake element 42 is resiliently supported relative to the brake caliper 41 in the direction of the X axis, preferably by means of biased plate-spring packets 44*a* and 44*b*.

The activating mechanism 400 of the safety brake device comprises an electromagnet 45, which is possibly mounted by means of a spring mounting 46 to be yielding. Moreover, the activating mechanism 400 comprises an activating lever 47 which is pivotably mounted in a pivot bearing 48 and thus forms a left-hand arm 49*a* and a right-hand arm 49*b*. Arranged behind the left-hand arm 49*a* is a switch 50 which stops the drive of the elevator installation 100*a* as soon as the activating lever 47 is pivoted out in counter-clockwise sense in a pivot direction 51 due to power interruption of the electromagnet 45. The power interruption of the electromagnet 45 takes place possibly through an electronic speed limiter (not illustrated in more detail). The activating lever 47 can include a first activating lever 47 and a second activating lever 76, where the first activating lever 47 is connected to the second activating lever 76 by a shaft 77, and the second activating lever 76 can be part of another safety brake device 38*c*.

The pivotation of the activating lever 47 out of an initial position $P_I$ in the pivot direction 51 is driven by an activating spring 52, which in the case of the illustrated embodiment of the safety brake device is constructed as a torsion spring. The right-hand arm 49*b* of the activating lever 47 has a dovetail-like end with a contact surface 53, which contact surface co-operates with an entrainer 54 arranged at a cam disc 55. The cam disc is rotatably mounted in a rotary bearing 56. The outward pivotation of the activating lever 47 in the pivot direction 51 produces rotation of the cam disc 55 through an activation rotational angle in a rotational direction 57 directed in counter-clockwise sense.

The cam disc 55 has on at least one side a cylindrical projection 58 which is arranged eccentrically with respect to the axis of rotation of the cam disc and this cylindrical projection 58 in turn has a convex peripheral outer surface 59, which co-operates with a concave inner surface 60 in the second brake element 43. The rotation of the cam disc 55 thus produces a displacement of the second brake element 43, which displacement also includes a component in the direction of the adjusting axis X. Through the rotation of the cam disc 55 the second brake element is thus moved against the guide web 7*d* of the guide rail 7.

It can be seen that the second brake element 43 has a cut-out 61, through which a peripheral surface 62 of the cam disc 55 protrudes. The safety brake device 38*c* is disposed, in the arrangement illustrated in FIG. 2, in a first operating state $P_1$ which corresponds with the normal operating state in which the safety brake device is disposed in normal operation of the elevator installation 100*a*. The brake elements 42 and 43 are spaced from the guide web 70 of the guide rail 7*c*. In addition, the peripheral surface 62 of the cam disc 55 is spaced from the guide web 7*d* of the guide rail 7*c*, since it has a flat 63 which in this first operating state $P_1$ is oriented parallel to the guide rail 7. The cam disc 55 is thereby resiliently held by a restraining spring 64 in a normal position. In this first operating state $P_1$ the activating lever 47 is held in its initial position $P_I$ by the electromagnet 45 against the force of the activating spring 52, which in the present example is constructed as a torsion spring.

Figure 3:
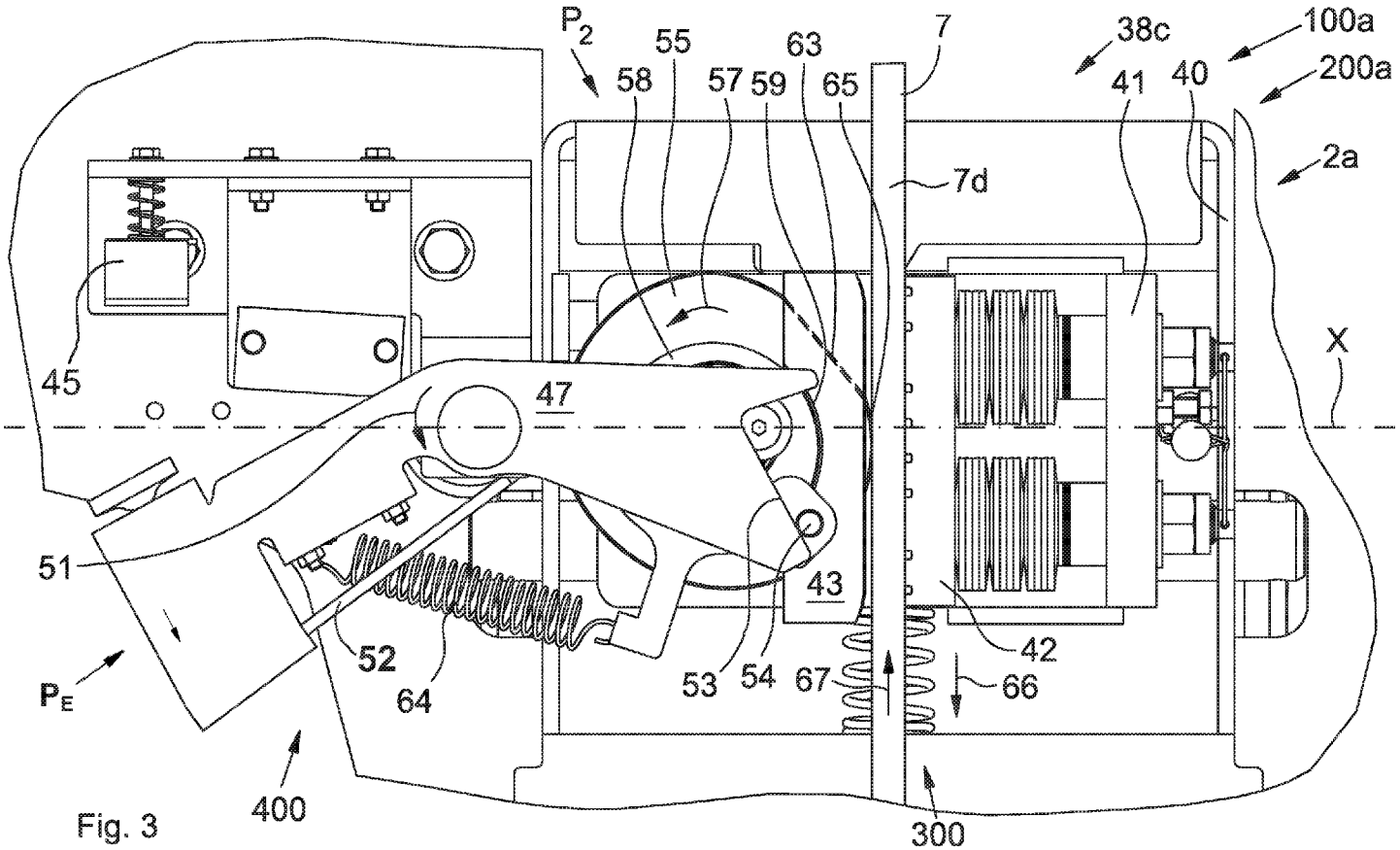
FIG. 3 shows the safety brake device of FIG. 2 in a front view and in a second operating state.

A second operating state $P_2$ is illustrated in FIG. 3, in which after detection of a safety—braking situation the electromagnet 45 has released the activating lever 47 and the activating lever has been pivoted out of its initial position in counter-clockwise sense in the pivot direction 51 by the activating spring 52. The entrainer 54 of the cam disc 55 is just still in contact with a first contact surface 53 in the end region of the activating lever 47 and the cam disc 55 has been rotated in the rotational direction 57 through the activation rotational angle so that a peripheral section 65, which adjoins the flat 63 and increases in radius, of the cam disc has come into contact with the guide web 7*d* of the guide rail 7.

The safety brake device 38*c*, particularly the activating lever 47 and the cam disc 55, are disposed in the second operating state $P_2$ in which further rotation of the cam disc 55 no longer depends on a movement of the activating lever 47, since as a consequence of the contact of the peripheral section 65, which increases in radius, of the cam disc 55 with the guide rail 7 and the upward movement 67, which is present, of the guide rail 7 relative to the cam disc further rotation of the cam disc is produced. The restraining spring 64 ensuring the normal position of the cam disc in normal operation is in that case stretched. Rolling of the peripheral section 65, which increases in radius, on the guide rail 7 produces a displacement of the entire brake caliper 41 or of the entire brake equipment 300 relative to the guide rail, wherein initially the first brake element 42 comes to bear against the guide web 7*d* of the guide rail 7 and subsequently the plate-spring packets 44*a*, 44*b* are increasingly compressed. Resulting from the compression of the plate-spring packets are increasing pressing forces not only between the cam disc 55 and the guide web 7*d* of the guide rail, but also between the first brake element 42 and the guide web 7*d*. The convex peripheral outer surface 59 of the cylindrical projection 58 eccentrically connected with the cam disc 55 has still not brought the brake element 43 to bear against the guide web 7*d* of the guide rail 7.

Figure 4:
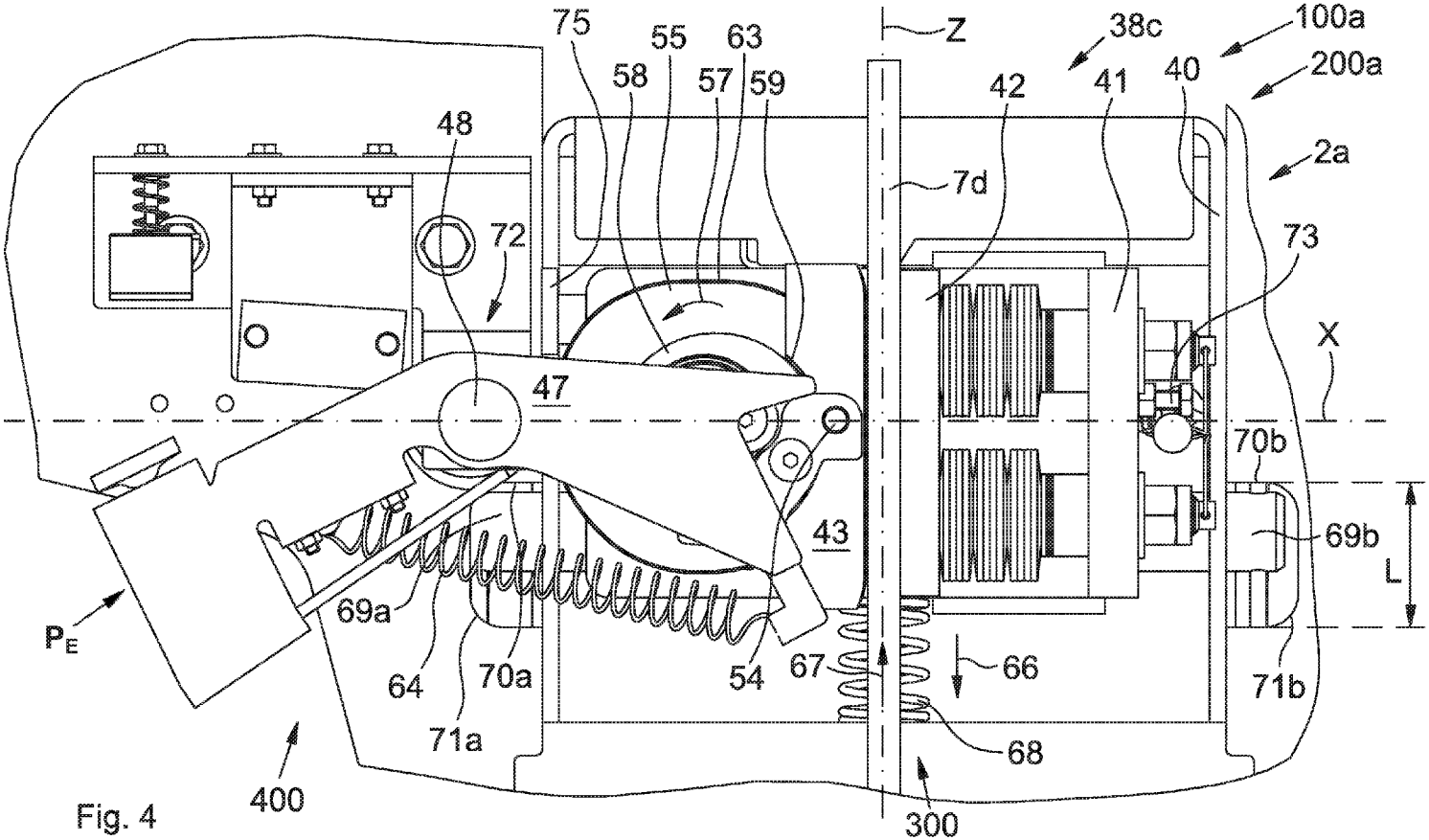
FIG. 4 shows the safety brake device of FIGS. 2 and 3 in a state in which the brake equipment has achieved its maximum braking force.

FIG. 4 shows the safety brake device 38*c* in a state in which the brake equipment 300 has reached its maximum braking force. Due to the pressing of the cam disc 55 against the guide web 7*d* of the guide rail 7 and the progressing downward movement 66 of the safety brake device 38*c* or the progressing relative upward movement 67 of the guide rail 7 a further rotation of the cam disc 55 and thus a further rolling of its peripheral section 65, which increases in radius, on the guide rail have taken place. As a consequence, the brake caliper 41 has displaced a corresponding distance to the left, whereby the plate-spring packets 44*a*, 44*b* were more strongly compressed and the pressing forces between the cam disc 55 and the guide web 7*d* as well as between the first brake element 42 and the guide web were further increased. In the course of this process the eccentricity of the cylindrical projection 58 of the cam disc has the effect that the second brake element 43 now bears fully against the guide web 7*d* of the guide rail 7 and a pressing force between the second brake element 43 and the guide web 7*d* has built up. The reaction force to this pressing force has in that case acted on the cam disc 55 by way of the cylindrical projection 58 in such a manner that it has counteracted the pressing force between the cam disc and the guide web 7*d*. After activation of the brake equipment 300 the cam disc 55 has thus rotated until the reaction force to the pressing force of the second brake element 43 has reduced the pressing force between the cam disc 55 and the guide web 7*d* to such an extent that the residual friction between cam disc 55 and guide web 7*d* is no longer sufficient for further rotation of the cam disc. If in the case of an actual safety-braking situation this state of the safety brake device has been reached the cam disc together with the two brake elements slides on the guide web until the braking forces built up in the described process have brought the load receiving means to a standstill.

It is apparent from FIGS. 2, 3 and 4 that the brake equipment 300, which substantially comprises the brake caliper 41, the first brake element with the plate-spring packets 44*a*, 44*b*, the second brake element 43 and the cam disc 55, is constructed as a unit displaceable in the support frame 40 also in vertical direction. For that purpose the brake equipment is guided in vertically arranged slots 71*a* and 71*b* of the support frame 40 by means of support pins 69*a* and 69*b*. A support spring 68, which resiliently supports the brake equipment on the support frame 40, is arranged and biased so that the brake equipment 300 is raised in the direction of the vertical axis Z, to such an extent that the support pins 69*a* and 69*b* guided in the slots 71*a* and 71*b* hit against the upper ends 70*a* and 70*b* of the slots. In this way a relative movement between the brake equipment 300 and the support frame 40 of the load receiving means in vertical direction is made possible, which, as described in the following, helps release the brake equipment 300 fixedly clamped on the guide rail after a safety-braking process and in that case resets the safety brake device into the first operating state $P_1$, i.e. into its normal operating state.

FIG. 4 also shows the situation of the safety brake device prior to such a resetting process. The activating lever 47 is in that case in its activating position pivoted out of its initial position and no longer has contact with the entrainer 54 of the cam disc 55. The restraining spring 64 serving for yielding positioning of the cam disc in its normal position is stretched to a maximum.

Figure 5:
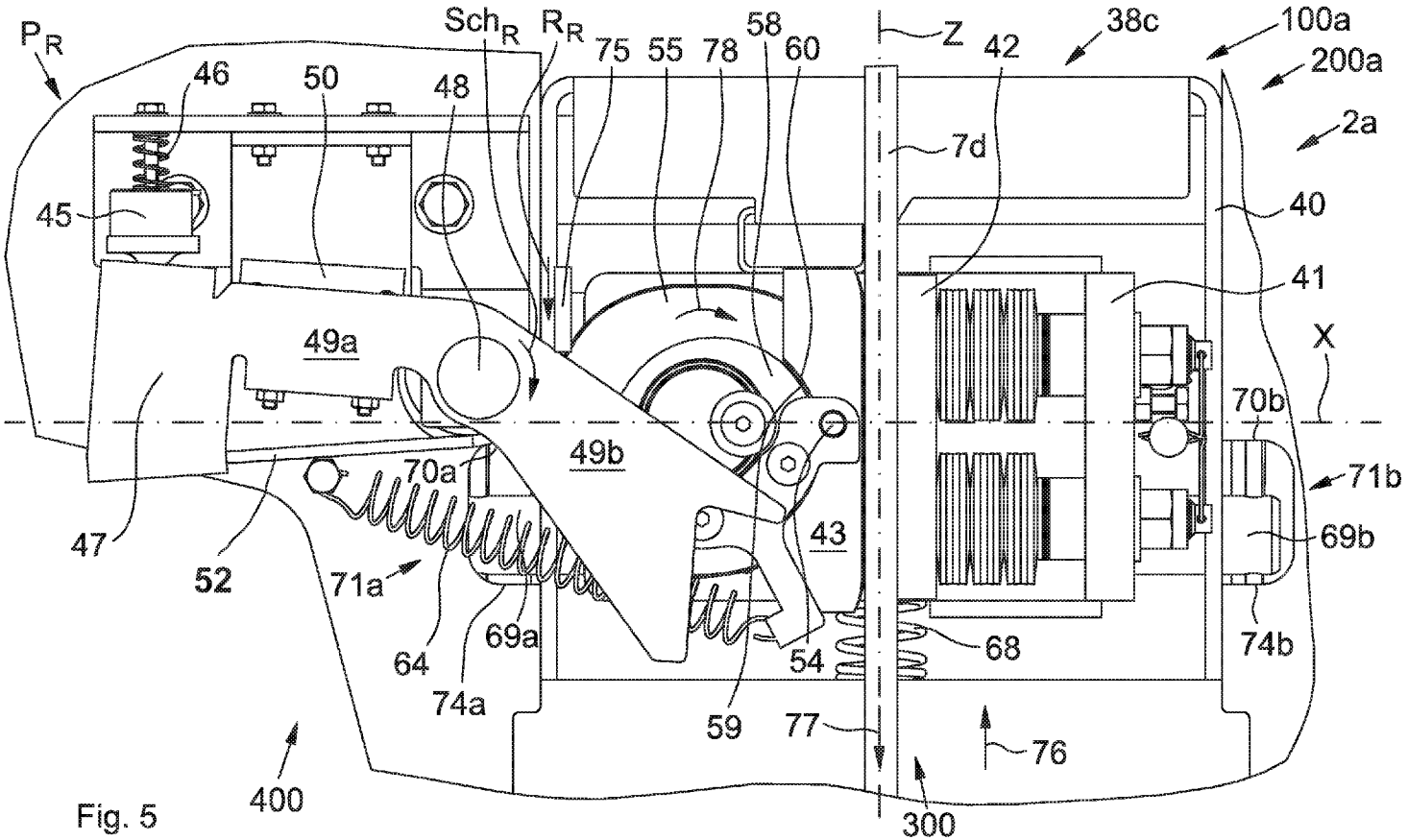
FIG. 5 shows the safety brake device of FIGS. 2 to 4, similarly in a front view, in the case of resetting.

FIG. 5 shows the safety brake device 38*c* during a resetting process. For resetting of the safety brake device the load receiving means 2*a* together with its support frame 40 is raised possibly by means of the elevator drive, which has the consequence of a downwardly directed relative movement of the guide rail or the guide rail web 7*d* with respect to the safety brake device 38*c*. This has the effect that the entire braking equipment 300, which comprises the brake caliper 41, the first brake element 42 with the plate-spring packets 44*a*, 44*b*, the second brake element 43 and the cam disc 55 and which is fixedly clamped on the guide rail web 7*d*, is downwardly displaced relative to the support frame against the force of the support spring 68. This downward displacement of the brake equipment 300 relative to the support frame 40 is limited in that the support pins 69*a* and 69*b* guiding the brake equipment hit the lower abutments 74*a* and 74*b*, respectively, of the slots 71*a* and 71*b*, respectively, vertically arranged in the support frame 40. Until this hitting takes place the load receiving means moved upwardly by the elevator drive has accumulated a sufficiently large amount of kinetic energy in order to move the brake equipment, which is fixedly clamped on the guide rail web 7*d*, against its braking force upwardly relative to the guide rail web. Through this relative movement the cam disc 55 is rotated by the guide rail web 7*d* to such an extent in the rotational direction 78, i.e. counter to the rotational direction occurring on activation of the safety brake device, until the cam disc has reached its normal position which is produced by the restraining spring 64 and in which the cam disc is spaced, due to its flat, from the guide rail web. Through this process not only the pressing forces between the brake elements 42, 43 and the guide rail web are eliminated, but also, as described in the following, the activating lever 47 is reset into its initial position.

The resetting spring 64 is fastened at one end, as apparent in the example according to FIG. 5, to the support frame. Alternatively, this end of the resetting spring 64 can also be fastened to the activating lever 47 or coupled thereto. This can be advantageous, since in the case of activation and subsequent movement of the activating lever 47 a biasing and correspondingly the resetting force of the resetting spring 64 are reduced.

As evident from FIGS. 3 and 4, the activating lever 47 at the end of its activating movement driven by the activating spring 52 is stopped by a lever abutment 75 acting on the right-hand arm 49*b*. In the case of the form of embodiment illustrated here this lever abutment 75 is connected with the brake equipment 300, which is vertically displaceable relative to the support frame 40, or with the brake caliper 41, whilst the activating lever 47 is rotatably mounted on the support frame 40 by way of the pivot bearing 48. Due to the fact that during the resetting process described in the foregoing in connection with FIG. 5 the support frame and the activating lever 47 mounted thereon have been raised, whilst the brake equipment 300, which is fixedly clamped on the guide rail web 7*d*, and the lever abutment 75 fastened thereto have moved downwardly relative to the support frame, the lever abutment 75 during this resetting process exerts a force, which acts in the resetting direction $R_R$, on the right-hand arm 49*b* of the activating lever 47. A torque directed in the resetting pivot direction $Sch_R$ derived from this force has arisen in the activating lever and has moved the activating lever into a resetting position $P_R$ against the action of the activating spring 52, in which position the electromagnet 45 resiliently mounted in upward direction has again picked up the activating lever 47 by switching-on of the magnetization current and subsequently fixed it in the initial position $P_I$ of the activating lever.

Figure 6:
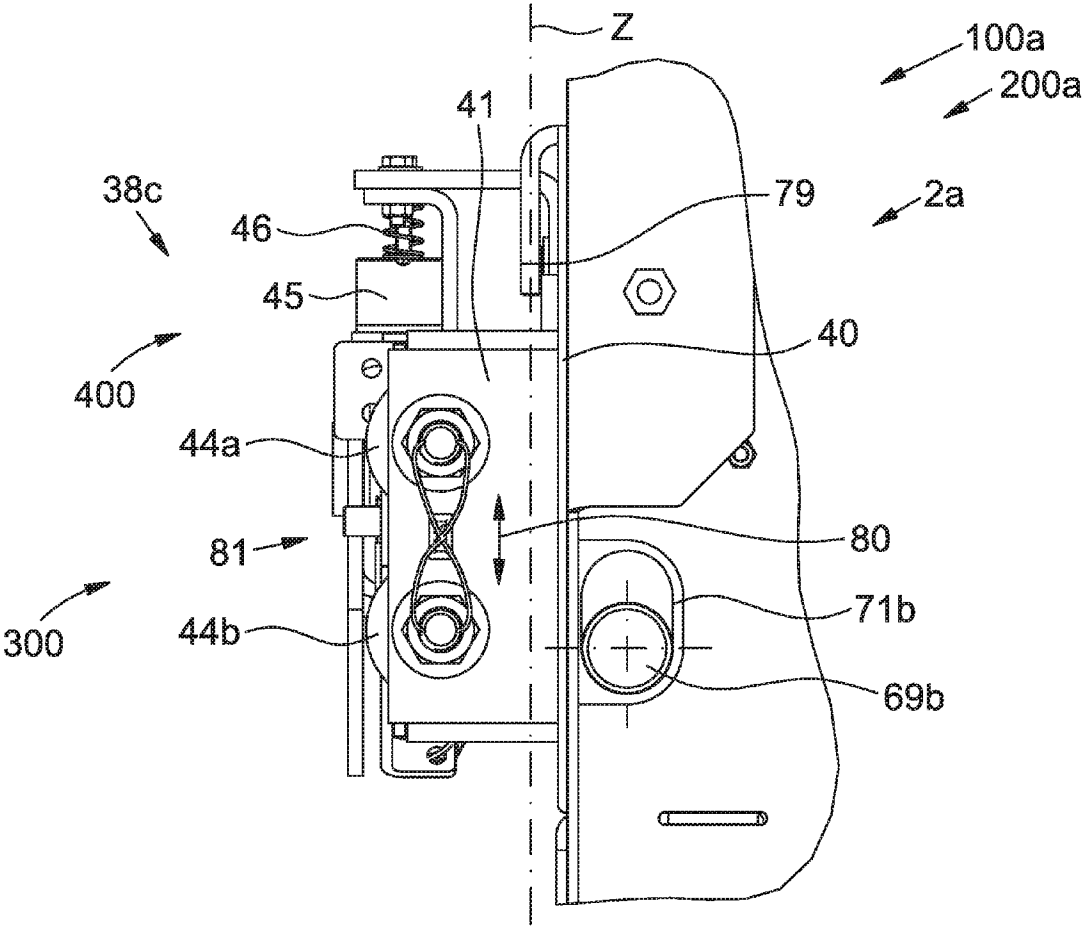
FIG. 6 shows a side view of the safety brake device of FIGS. 2 to 5.

A side view of the safety brake device 38*c* illustrated in FIGS. 2 to 5 is shown in FIG. 6. The arrangement of the support pin 69*b* guided in the slot 71*b* of the support frame 40 is, for example, readily recognizable therein. Moreover, it is readily apparent that the brake caliper 41 is also guided by a guide 79 during description of an upward/downward movement 80. The plate-spring packets 44*a* and 44*b* are possibly secured in common by way of a securing means 81.

Figure 7:
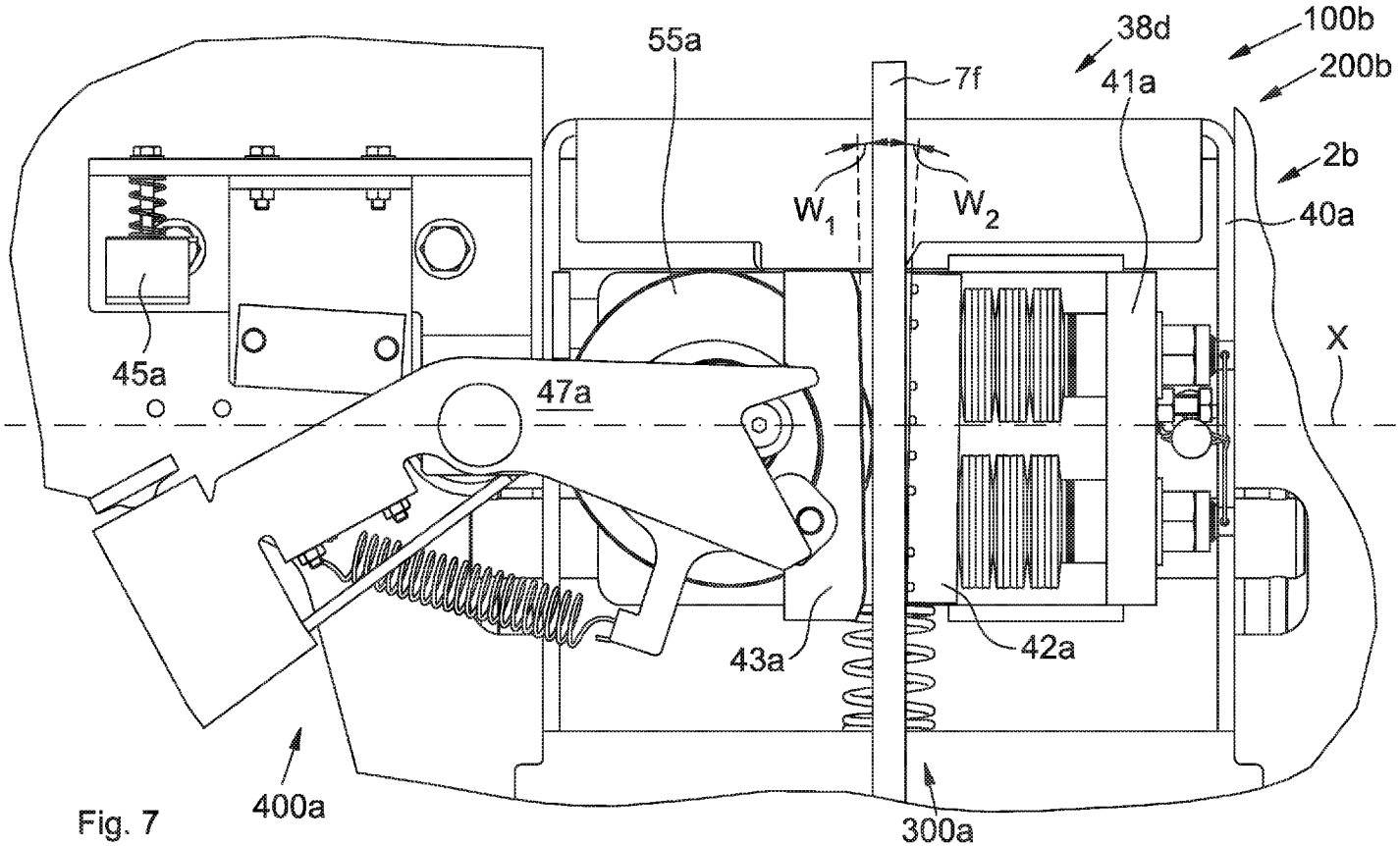
FIG. 7 shows a front view of a second variant of embodiment of a safety brake device with brake elements set at an inclination.

A safety brake device 38*d* with brake equipment 300*a* is illustrated in FIG. 7, which is characterized in that the brake elements 42*a* and 43*a* are each arranged at an angle $W_1$ and $W_2$ of incidence relative to a guide rail 7*e*. The angles $W_1$ and $W_2$ of incidence are possibly identical. When a braking or fixing process in downward direction is initiated smaller vibrations are as a result generated. The safety brake device 38*d* otherwise corresponds with the safety brake device 38*c* of FIG. 3 and the setting situation, which is illustrated there, of a cam disc 55*a* and an activating mechanism 400*a* with an activating lever 47*a* and an electromagnet 45*a*. The safety brake device 38*d* comprises a brake caliper 41*a* which is adjustably mounted in a support frame 40*a* of a load receiving means 2*b*. The safety brake device 38*d* is a component of an elevator installation 100*b* or a speed limiting system 200*b*.

Figure 8:
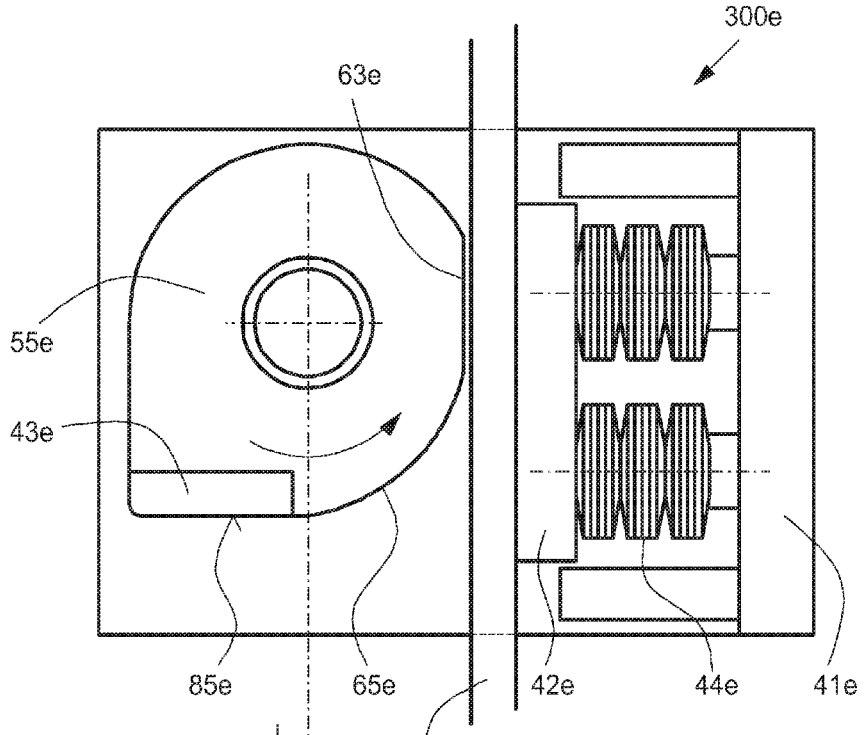
FIG. 8 shows a variant of a cam disc with integrated brake element in its normal position.

FIG. 8 schematically shows brake equipment 300*e* with a modified form of embodiment of a cam disc 55*e* for a safety brake device. In the case of this cam disc 55*e* the periphery of the cam disc is so designed that a peripheral section 65, which increases in radius, adjoins the flat 63*e*, the peripheral section 65 being followed by a straight, tangential peripheral section 85 constructed as a second brake element 43*e*. The brake element 43*e* can consist of the material of the cam disc or be a brake lining connected with the cam disc. In the case of activation of the safety brake device during travel of the load receiving means the peripheral section 65*e*, which increases in radius, of the cam disc 55*e* after rotation of the cam disc by the activating lever (not illustrated here) in counter-clockwise sense through an activation rotational angle comes into contact with the guide rail 7*e* moving upwardly relative to the cam disc. Through the friction between the periphery of the cam disc 55*e* and the guide rail 7*e* the cam disc is further rotated in counter-clockwise sense, wherein the rolling of the peripheral section 65*e*, which increases in radius, on the guide rail 7*e* produces a movement of the brake caliper 41*e* of the brake equipment 300*e* to the left, which has the consequence of a compression of the plate-spring packet 44*e* and a strong increase in the pressing forces between the cam disc 55*e* and the guide rail 7*e* as well as between the first brake element 42*e* and the guide rail 7*e*.

Figure 9:
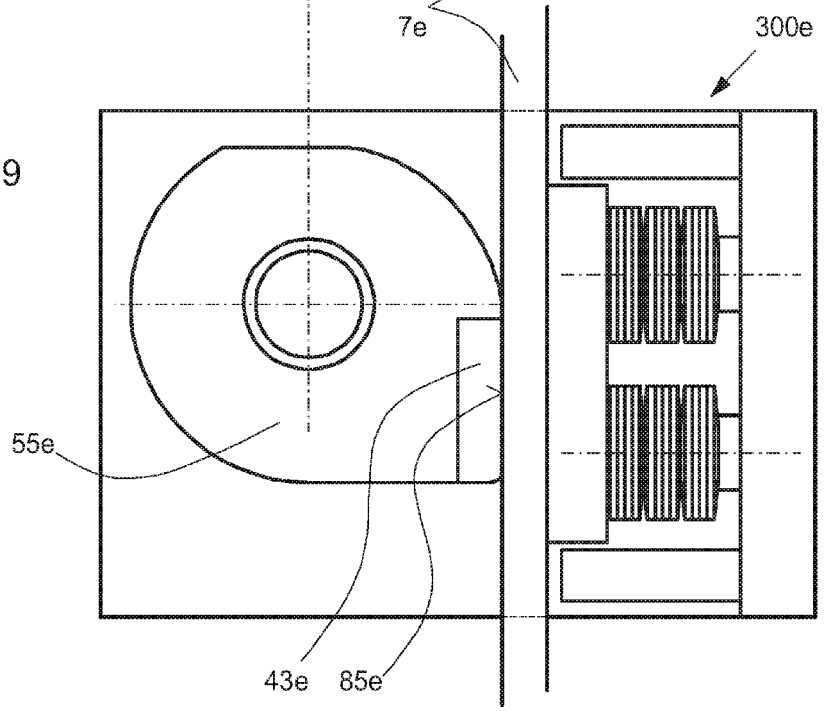
FIG. 9 shows the cam disc according to FIG. 8 in its braking position.

FIG. 9 shows the brake equipment 300 according to FIG. 8 in the state in which after activation by the activating lever the cam disc 55*e* was rotated by the guide rail 7*e* to such an extent that the straight, tangential peripheral section 85*e* bears against the guide rail 7*e* and prevents further rotation of the cam disc. In this state, the brake equipment 300*e* slides—with the afore-mentioned pressing forces between the second brake element 43*e* of the cam disc 55*e* and the guide rail 7*e* as well as between the first brake element 42*e* and the guide rail 7*e*—relative to the guide rail until the friction generated by the pressing forces has brought the load receiving means to a standstill.

Figure 10:
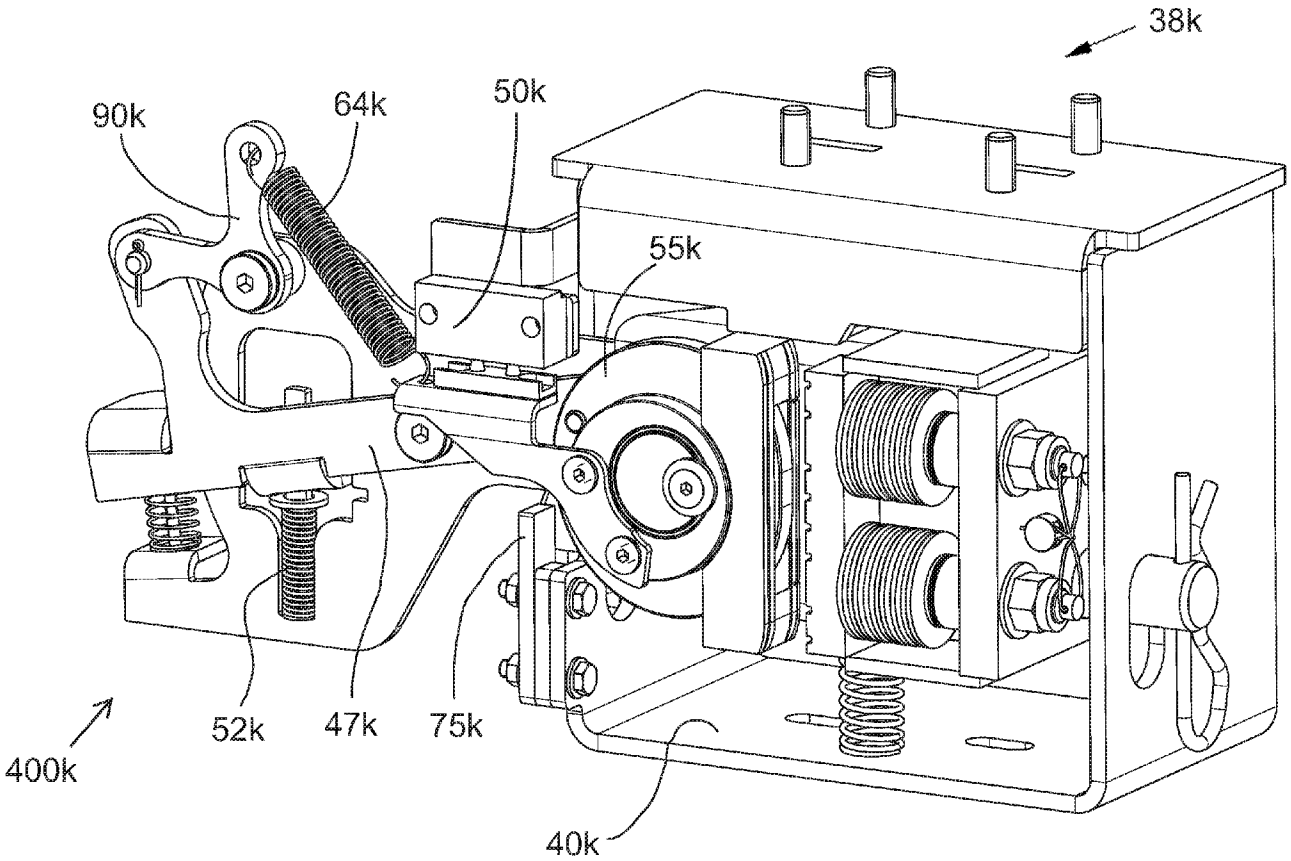
FIG. 10 shows a further form of embodiment of a safety brake device.

FIG. 10 shows a modified form of embodiment of a safety brake device, which has substantially the same features as the safety brake device described in FIGS. 2 to 6 and also fulfills the same purpose. However, some components of this modified form of embodiment are somewhat differently arranged and changed in part. The most significant difference relative to the afore-described safety brake device consists in that the activating mechanism 400*k* is not fixed to the support frame of the load receiving means, but is connected with the brake equipment or with the brake caliper. In order to be able to realize resetting, which results from a vertical relative movement between the support frame and the brake equipment, of the activating lever in the case of this arrangement as well, the lever abutment 75*k* is here connected with the support frame 40*k* instead of with the brake caliper.

In this form of embodiment the activating lever 47*k* is so arranged that it activates the cam disc 55*k* when it moves in clockwise sense. This activating movement is no longer driven by an activating spring in the form of a torsion spring, but by a helical spring 52*k* acting from below on the left-hand arm of the activating lever 47*k*. The electromagnet, which restrains the activating lever in its initial position $P_I$ and which is not visible in FIG. 10, here acts from below on the left-hand arm of the activating lever, and also the coupling between the right-hand arm of the activating lever 47*k* and the cam disc 55*k* is designed somewhat differently. Also apparent is an additional pivot lever 90*k*. This has the effect that one end of the restraining spring 64*k* resiliently holding the cam disc 55*k* in its normal position is positioned in dependence on the position of the activating lever 47*k*. The purpose of this measure is to not allow the cam disc to rise too strongly against the restraining force, which urges it into its normal position, of the restraining spring during rotation of the cam disc. In that case, the switch 50*k* is possibly controlled by the position of the cam disc 55*k* so that on rotation of the cam disc out of the normal position—regardless of the position of the activating lever—the switch 50*k* is actuated and thus the drive of the elevator stopped. This construction of the switch 50*k* as well as the arrangement of the restraining spring 64*k* can also be used analogously in the case of the preceding embodiments.

In at least some embodiments, remaining functions are substantially unchanged relative to the originally described form of embodiment of the safety brake device.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention.

We claim:

1. A safety brake device for a load receiving component of an elevator installation, the safety brake device comprising:

brake equipment, the brake equipment being configured to work with a guide rail for the load receiving component, the brake equipment comprising a cam disc rotatable about a cam disc axis; and an electrically controlled activating mechanism, the activating mechanism being configured to activate the safety brake device by rotating the cam disc through an activation rotational angle such that the cam disc contacts the guide rail, the activating mechanism comprising a pivotably mounted activating lever and an activating spring, the activating spring directly causing a pivot movement of the activating lever prior to contact of the cam disc with the guide rail, the activating lever being fixed in an initial position in a first operating state of the safety brake device and the activating lever being pivotally driven by the activating spring from the initial position to an end position when the activating mechanism is released in a second operating state of the safety brake device, the activating lever being coupled with the cam disc such that the pivot movement of the activating lever from the initial position toward the end position rotates the cam disc through the activation rotational angle.

2. The safety brake device according to claim 1, the electrically controlled activating mechanism further comprising an electromagnet, the activating lever being fixable in the initial position by activating the electromagnet, the activating lever being releasable by deactivating the electromagnet for moving the activating lever toward the end position.

3. The safety brake device according to claim 2, the activating lever being configured to rotate the cam disc when the electromagnet is deactivated, where contact between the cam disc and the guide rail further rotates the cam disc.

4. The safety brake device according to claim 1, the cam disc comprising:

a periphery with a flat surface; and a peripheral section adjoining the flat surface, the peripheral section having a radius increasing with rotational angle.

5. The safety brake device according to claim 4, the cam disc further comprising a cylindrical projection, the cylindrical projection eccentrically arranged with respect to the axis of rotation of the cam disc, the cylindrical projection comprising a convex outer surface receivable by a concave inner surface of a first brake element.

6. The safety brake device according to claim 5, further comprising a second brake element, the second brake element including a concave inner surface that cooperates with a convex peripheral outer surface of the cylindrical projection, the second brake element including a cut-out through which the periphery of the cam disc protrudes.

7. The safety brake device according to claim 6, the second brake element comprising a straight, tangential peripheral section of the peripheral section of the cam disc.

8. The safety brake device according to claim 1, the safety brake device being displaceable in the load receiving component or in a support frame of the load receiving component.

9. The safety brake device according to claim 8, further comprising a lever abutment, the lever abutment being configured to move the activating lever into a resetting position when the load receiving component is raised for resetting the safety brake device.

10. The safety brake device according to claim 1, further comprising a switch activatable by the pivot movement of the activating lever or by rotation of the cam disc.

11. The safety brake device according to claim 1, the activating lever being a first activating lever, the first activating lever being connected by a shaft to a second activating lever, the second activating lever being part of another safety brake device.

12. The safety brake device according to claim 1 being arranged on the load receiving component.

13. The safety brake device according to claim 1, wherein the activating spring is a torsion spring.

14. A safety brake device method, comprising:

retaining an activating lever of a safety brake device in an initial position using an activated electromagnet;

directly pivoting the activating lever from the initial position toward an end position using an activating spring and by deactivating the electromagnet;

rotating a rotatably mounted cam disc using the pivoting activating lever;

moving a periphery of the cam disc into contact with a guide rail, the guide rail moving relative to the safety brake device; and further rotating the cam disc using the guide rail, wherein a peripheral section of the cam disc having an increasing radius rolls on the guide rail, the cam disc and a brake element of brake equipment being pressed against the guide rail and braking a load receiving component.

15. The method according to claim 14, further comprising resetting the safety brake device, the resetting comprising, moving the load receiving component relative to the brake equipment, the brake equipment being fixedly seated on the guide rail, the moving being limited by an upper abutment and a lower abutment, as a result of the moving the load receiving component and using a lever abutment, pivoting the activating lever against the activating spring into a resetting position, and activating the electromagnet.

16. The method according to claim 15, further comprising:

pressing the lower abutment against the brake equipment; and releasing the cam disc from against the guide rail.

17. The method according to claim 14, wherein the activating spring is a torsion spring.

18. A safety brake device for a load receiving component of an elevator installation, the safety brake device comprising:

brake equipment for connecting the load receiving component with a guide rail by friction couple, the brake equipment comprising a cam disc rotatable about a cam disc axis; and an electrically controlled activating mechanism for activating the safety brake device by rotating the cam disc through an activation rotational angle such that the cam disc contacts the guide rail, the activating mechanism comprising a pivotably mounted activating lever and an activating spring, the activating spring directly causing a pivot movement of the activating lever prior to contact of the cam disc with the guide rail, the activating lever being fixable in an initial position and being pivotally driven by the activating spring, the activating lever being movable from the initial position toward an end position when the activating mechanism is released, the activating lever being coupled with the cam disc such that the pivot movement of the activating lever from the initial position toward the end position rotates the cam disc through the activation rotational angle.

19. The safety brake device according to claim 18, the electrically controlled activating mechanism further comprising an electromagnet, the activating lever being fixable in the initial position by activating the electromagnet, the activating lever being releasable by deactivating the electromagnet for moving the activating lever toward the end position.

20. The safety brake device according to claim 19, the activating lever being configured to rotate the cam disc when the electromagnet is deactivated, where contact between the cam disc and the guide rail further rotates the cam disc.

21. The safety brake device according to claim 18, the cam disc comprising a periphery with a flat surface and a peripheral section adjoining the flat surface, the peripheral section having a radius increasing with rotational angle.

22. The safety brake device according to claim 21, the cam disc further comprising a cylindrical projection, the cylindrical projection eccentrically arranged with respect to the axis of rotation of the cam disc, the cylindrical projection comprising a convex outer surface receivable by a concave inner surface of a first brake element.

23. The safety brake device according to claim 18, wherein the activating spring is a torsion spring.

* * * * *